US007090032B2

(12) United States Patent
Wada et al.

(10) Patent No.: US 7,090,032 B2
(45) Date of Patent: Aug. 15, 2006

(54) ELECTRIC POWER TOOL

(75) Inventors: Yasuo Wada, Fuchu (JP); Shinji Morimune, Fuchu (JP)

(73) Assignee: Ryobi Ltd., Hiroshima (JP)

( * ) Notice: Subject to any disclaimer, the term of this patent is extended or adjusted under 35 U.S.C. 154(b) by 0 days.

(21) Appl. No.: 11/048,779

(22) Filed: Feb. 3, 2005

(65) Prior Publication Data

US 2005/0183870 A1 Aug. 25, 2005

(30) Foreign Application Priority Data

Feb. 23, 2004 (JP) ..... 2004-046028

(51) Int. Cl.
*E21B 3/00* (2006.01)

(52) U.S. Cl. ..... 173/217; 173/216; 173/205; 173/128

(58) Field of Classification Search ..... 173/217, 173/216, 117, 205, 128
See application file for complete search history.

(56) References Cited

U.S. PATENT DOCUMENTS 5,056,607 A * 10/1991 Sanders ..... 173/48
6,394,191 B1 * 5/2002 Nakane ..... 173/217
6,725,945 B1 * 4/2004 Sugimoto et al. ..... 173/117
2003/0089510 A1 * 5/2003 Sugimoto et al. ..... 173/117
2005/0236170 A1 * 10/2005 Lee ..... 173/216
2005/0257945 A1 * 11/2005 Justis et al. ..... 173/217
2006/0000623 A1 * 1/2006 Ortt et al. ..... 173/1

FOREIGN PATENT DOCUMENTS

JP A-2001-054874 2/2001
JP A-2003-145439 5/2003
JP 2005066804 A * 3/2005

* cited by examiner

*Primary Examiner*—Scott A. Smith
*Assistant Examiner*—Brian Nash
(74) *Attorney, Agent, or Firm*—Oliff & Berridge, PLC

(57) ABSTRACT

An electric power tool includes a housing, an inner case and a hammer case. The housing receiving a motor has a pair of half portions. The inner case receives a planetary gear train. An input side of the planetary gear train is connected to a drive shaft of the motor. The housing receives the inner case. The hammer case receives a hammer unit. An input side of the hammer unit is connected to an output shaft of the planetary gear train to convert rotation of the output shaft of the planetary gear train into an intermittent striking power outputted from an output shaft of the hammer unit. The hammer case receives the inner case having recesses. The hammer case has elongated holes aligned with the recesses. Each half portion has bosses engaging with the elongated holes of the hammer case, which are aligned with the recesses of the inner case.

5 Claims, 8 Drawing Sheets

ELECTRIC POWER TOOL

BACKGROUND OF THE INVENTION

1. Field of the Invention

The present invention relates to an electric power tool such as an impact driver.

2. Related Art

An impact driver includes a housing, a hammer case received in the housing, and an inner case received in the hammer case. The housing accommodates not only the hammer case and the inner case, but also a motor having a drive shaft, a switch and the other structural components. The inner case accommodates a planetary gear train having an input side and an outputs shaft, which is connected to the drive shaft of the motor to transmit power of the motor to the output shaft at reduced speed. The hammer case accommodates a hammer unit having an input side and an output shaft. The input side of the hammer unit is connected to the output shaft of the planetary gear train to convert rotational motion of the output shaft of the planetary gear train into an intermittent striking power outputted from the output shaft of the hammer unit. Japanese Patent Provisional Publication No. 2003-145439 describes such a structure of the impact driver.

In the conventional impact driver, the inner case is inserted into the hammer case, and then the hammer case is secured to the housing by means of screws. The housing and the hammer case are provided on their peripheries with bosses. The corresponding bosses are fastened by screws so as to fix the hammer case to the housing.

In addition, the inner case is fixed to the housing by means of screws, and the hammer case is fixed to the inner case by means of screws (see the above-mentioned Japanese Patent Provisional Publication No. 2003-145439).

However, the former conventional impact driver has the bosses projecting outward so as to hinder an operator from carrying out a working operation at a corner or narrow portion to be worked or to damage a material made for example of wood into which screws are to be inserted.

In addition, the latter conventional impact driver involves the following problems:

(1) The hammer case is connected indirectly to the housing through the inner case, thus leading to a possible deterioration in securing force by which the hammer case is supported on the housing.

(2) The hammer case is fastened to the housing by turning the screws into threaded bores formed in the hammer case, with the result that an intermittent striking power generated by the hammer unit and its reaction force are transmitted through the housing and the hammer case to the screws in the form of rotational force to loosen them.

(3) It is not easy to determine a relative position among the housing, the inner case and the hammer case, thus leading to a complicated assembling or disassembling operation.

(4) The inner case and the hammer case are connected in this order to the housing. When an inspection or repair for example of switching elements accommodated in the housing is carried out, the housing cannot be opened until the hammer case is removed from the inner case and then, the inner case is removed from the housing. Accordingly, the inspection or repair operation becomes complicated.

SUMMARY OF THE INVENTION

An object of the present invention is therefore to provide an electric power tool, which can solve the above-mentioned problems and inconvenience.

In order to attain the aforementioned object, the electric power tool according to one of aspects of the present invention comprises: a housing in which a motor having a drive shaft is disposed, the housing being composed of a pair of half portions that are to be assembled into a united body; an inner case for receiving a planetary gear train having an input side and an output shaft, the input side of the planetary gear train being connected to the drive shaft of the motor to transmit power of the motor to the output shaft at reduced speed, the inner case being received in the housing; and a hammer case for receiving a hammer unit having an input side and an output shaft, the input side of the hammer case being connected to the output shaft of the planetary gear train to convert rotational motion of the output shaft of the planetary gear train into an intermittent striking power outputted from the output shaft of the hammer unit, the inner case being received in the hammer case, wherein: the inner case has on an outer peripheral surface thereof at least one recess; the hammer case has at least one elongated hole that is aligned with the at least one recess of the inner case; and each of the half portions has bosses through which fastening members pass to fasten the half portions into the united body, at least one of the bosses being engageable with the at least one elongated hole of the hammer case, which is aligned with the at least one recess of the inner case.

According to the present invention, the hammer case in which the inner case has been inserted, is received in the housing, with the result that securing force by which the hammer case is supported on the housing is enhanced, thus leading to increased strength of the power tool. In addition, the inner case has at least one recess, the hammer case has at least one elongated hole, which is aligned with at least one recess of the inner case, and the half portion has bosses so that one of the bosses is engageable with the at least one elongated hole of the hammer case, which is aligned with the at least one recess of the inner case. As a result, it is possible to make positional determination among the hammer case, the inner case and the housing, thus providing an easy assembling operation. After completion of the assembling operation, engagement of the boss with the elongated hole of the hammer case, which is aligned with the recess of the inner case, prevents the hammer case from coming off the housing. The housing is disassembled into the half portions independently from the inner case and the hammer case, thus providing an easy inspection or repair in the housing. The bosses, which may be provided so as not to project outward from the outer surface of the housing, neither hinder an operator from carrying out a working operation at a corner or narrow portion to be worked, nor damage a material made for example of wood into which screws are to be inserted.

In the other aspect of the present invention, there may be adopted a structure in which the at least one of the bosses has an innermost end surface; the inner case is provided in the at least one recess with a bottom wall by which the at least one recess is defined, the bottom wall being coming into contact with the innermost end surface of the at least one of the bosses; and the hammer case is provided along the at least one elongated hole with a first pair of opposite edges, the first pair of opposite edges being coming into contact with the innermost end surface of the at least one of the bosses.

According to the present invention, the innermost end surface of the boss, the recess of the inner case and the first pair of opposite edges of the hammer case serve as members that prevent the inner case and the hammer case from unfavorably turning relative to the housing, even when an intermittent striking power generated by the hammer unit and its reaction force are transmitted in the form of rotational force through the inner case and the hammer case to the hosing. Consequently, it is possible to prevent an undesirable movement among the housing, the inner case and the hammer case in the circumferential direction thereof, thus leading to an extended service life of the power tool.

In the other aspect of the present invention, there may be adopted a structure in which the at least one of the bosses has a pair of opposite outer surfaces; and the inner case is provided in the at least one recess with an inner wall by which the at least one recess is defined, the inner walls being coming into contact with one of the pair of opposite outer surfaces of the at least one of the bosses; and the hammer case is provided along the at least one elongated hole with a second pair of opposite edges, the second pair of opposite edges being coming into contact with the pair of opposite outer surfaces of the at least one of the bosses, respectively.

According to the present invention, the pair of opposite outer surfaces of the boss, the inner wall of the inner case and the second pair of opposite edges of the hammer case serve as members that prevent, even when the intermittent striking power is transmitted through the inner case and the hammer case to the housing in the form of force acting in the axial direction of the housing, the inner case and the hammer case from coming off the housing in the axial direction of the housing. Consequently, it is possible to prevent an undesirable movement among the housing, the inner case and the hammer case in the axial direction of the housing, thus leading to an extended service life of the power tool.

In the other aspect of the present invention, there may be adopted a structure in which the inner case has a pair of opposite recesses serving as the at least one recess; the hammer case has a pair of opposite elongated holes serving as the at least one elongated hole, which are aligned with the pair of opposite recesses of the inner case, respectively; and each of the half portions has a pair of opposite bosses serving as the at least one of the bosses, the pair of opposite bosses being respectively engageable with the pair of opposite elongated holes of the hammer case, which are aligned with the pair of opposite recesses of the inner case, respectively.

DESCRIPTION OF THE PREFERRED EMBODIMENTS

Figure 1:
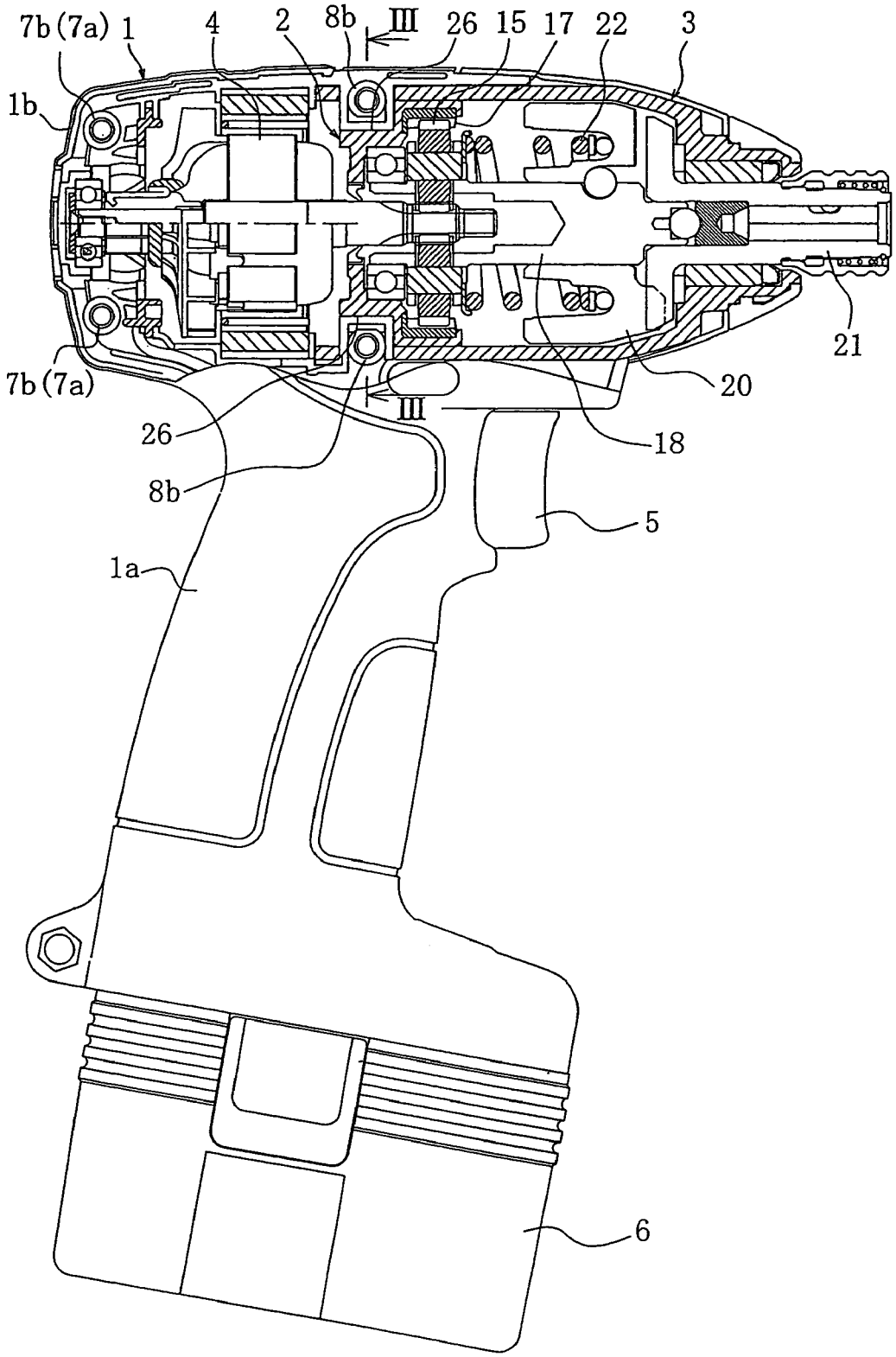
FIG. 1 is a front view of an electric power tool according to the embodiment of the present invention, with a part of one of a pair of half portions of a housing broken.

Now, embodiments of an electric power tool of the present invention will be described in detail below with reference to the accompanying drawings.

As shown in FIGS. 1 to 4, the electric power tool of the present invention is constructed as an impact driver. The impact driver has a fundamental structure including a housing 1 for forming an outer shell, an inner case 2 and a hammer case 3.

The housing 1 is divided into a pair of right-hand and left-hand half portions 1*a*, 1*b* that are to be assembled into a united body. The housing 1 has an upper side in which a motor 4 and the other structural components are received, and a lower side that serves as a handle. The motor 4 has a drive shaft 4*a*, which is placed on the central axial line of the upper side of the housing 1. The drive shaft 4*a* projects forward, i.e., toward the hammer case 3 and the inner case 2. A boundary zone between the upper and lower sides of the housing 1 receives a switch box (not shown) in which switches operated by a trigger switch 5 that projects from the front side of the handle. A battery 6 for supplying an electric power to the motor 4 is detachably secured to the lower end of the handle, i.e., the lower side of the housing 1. When an operator takes hold of the handle and pulls the trigger switch 5 with his/her finger, electric power is supplied from the battery 6 to the motor 4 through the switches in the switch box so that the drive shaft 4*a* of the motor 4 rotates under a predetermined controlled condition.

The right-hand and left-hand half portions 1*a*, 1*b* of the housing 1 are formed of synthetic resin by injection molding. The half portion 1*a* has bosses 7*a* and 8*a* integrally formed therewith and the other half portion 1*b* has bosses 7*b* and 8*b* integrally formed therewith. Screws 9 serving as fastening members pass through these bosses 7*a*, 7*b*, 8*a*, 8*b* to fasten the half portions 1*a*, 1*b* into the united body. The bosses 7*a*, 7*b*, 8*a*, 8*b* extend in the transverse direction, i.e., in the rightward or left ward direction of the housing 1. The bosses 7*a*, 8*a* have their end surfaces that are to be brought into contact with end surfaces of the other bosses 7*b*, 8*b*, respectively. These bosses 7*a*, 7*b*, 8*a*, 8*b* have threaded holes 10 into which the screws 9 are to be inserted. When the motor 4 and the other structural components are held between the half portions 1*a*, 1*b* and the screws 9 are inserted into the threaded holes 10 of the bosses 7*a*, 7*b*, 8*a*, 8*b* and fastened, the half portions 1*a*, 1*b* are assembled into the housing 1.

The housing 1 also has the other bosses through which the screws 9 pass to fasten the half portions 1*a*, 1*b* into the united body. However, these bosses 7*a*, 7*b*, 8*a*, 8*b* existing on the upper side of the housing 1 are placed in the inside of the housing so as not to project from the outer surface of the housing 1. The screws 9 do not project from the outer surface of the housing 1. According to such a housing 1 in which any one of these bosses 7*a*, 7*b*, 8*a*, 8*b* does not project from the outer surface of the housing 1, when an operator performs a screwing operation utilizing the impact driver at a corner or narrow portion, such a screwing operation can be carried out smoothly without causing damage to a material made for example of wood into which screws are to be inserted.

Figure 2:
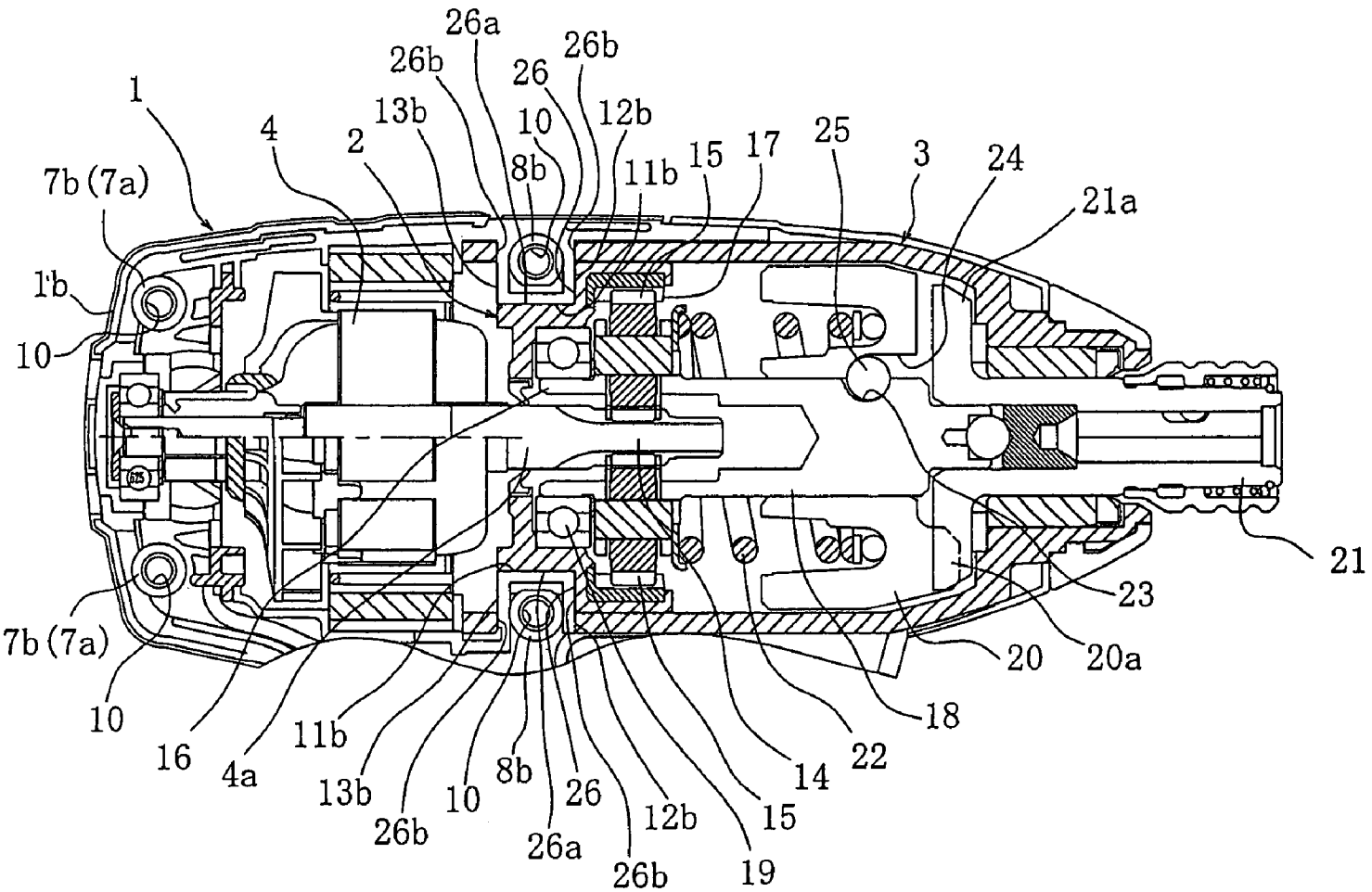
FIG. 2 is an enlarged cross-sectional view of essential structural components as shown in FIG. 1.
Figure 3:
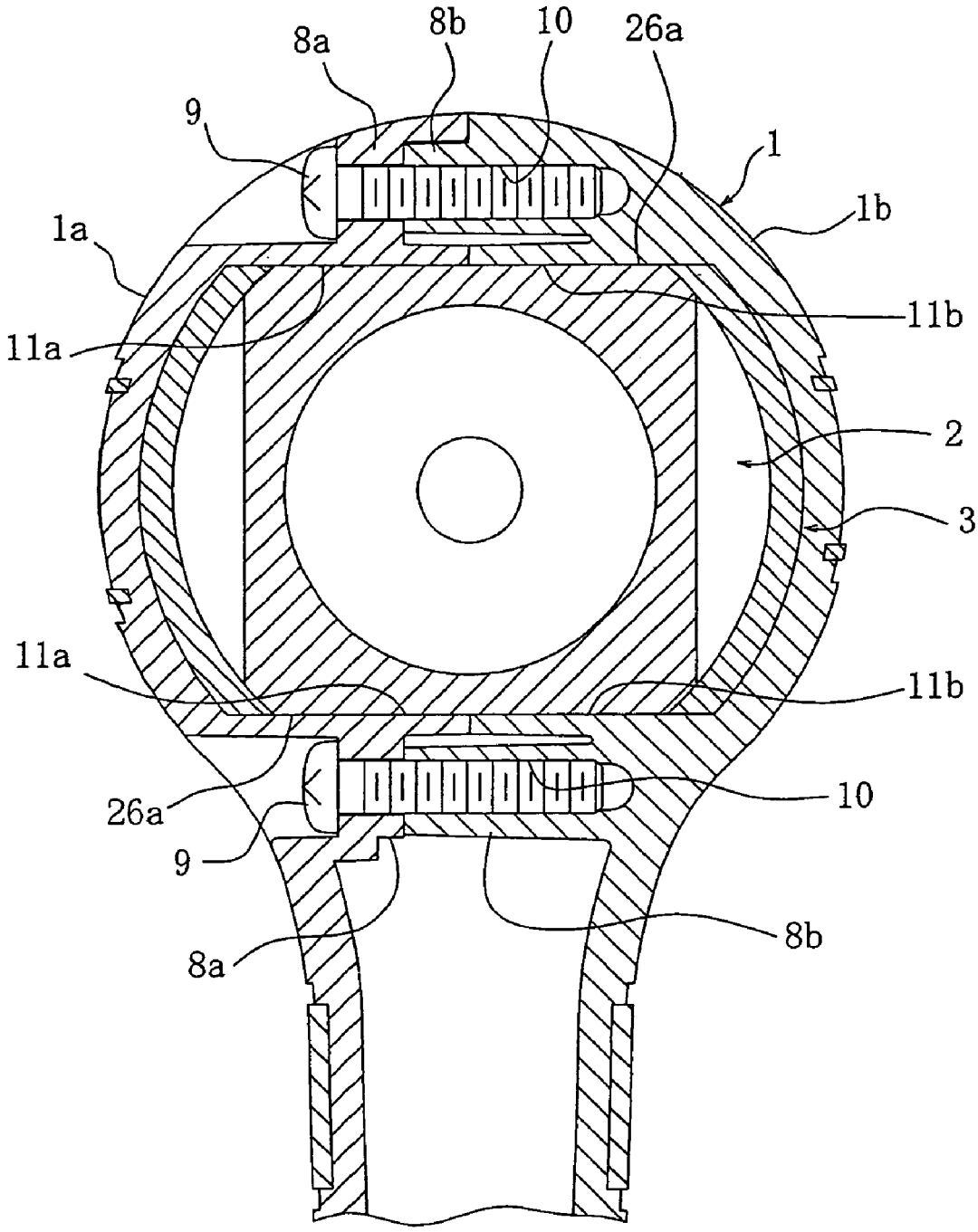
FIG. 3 is a cross-sectional view cut along the line III—III as shown in FIG. 1.
Figure 6:
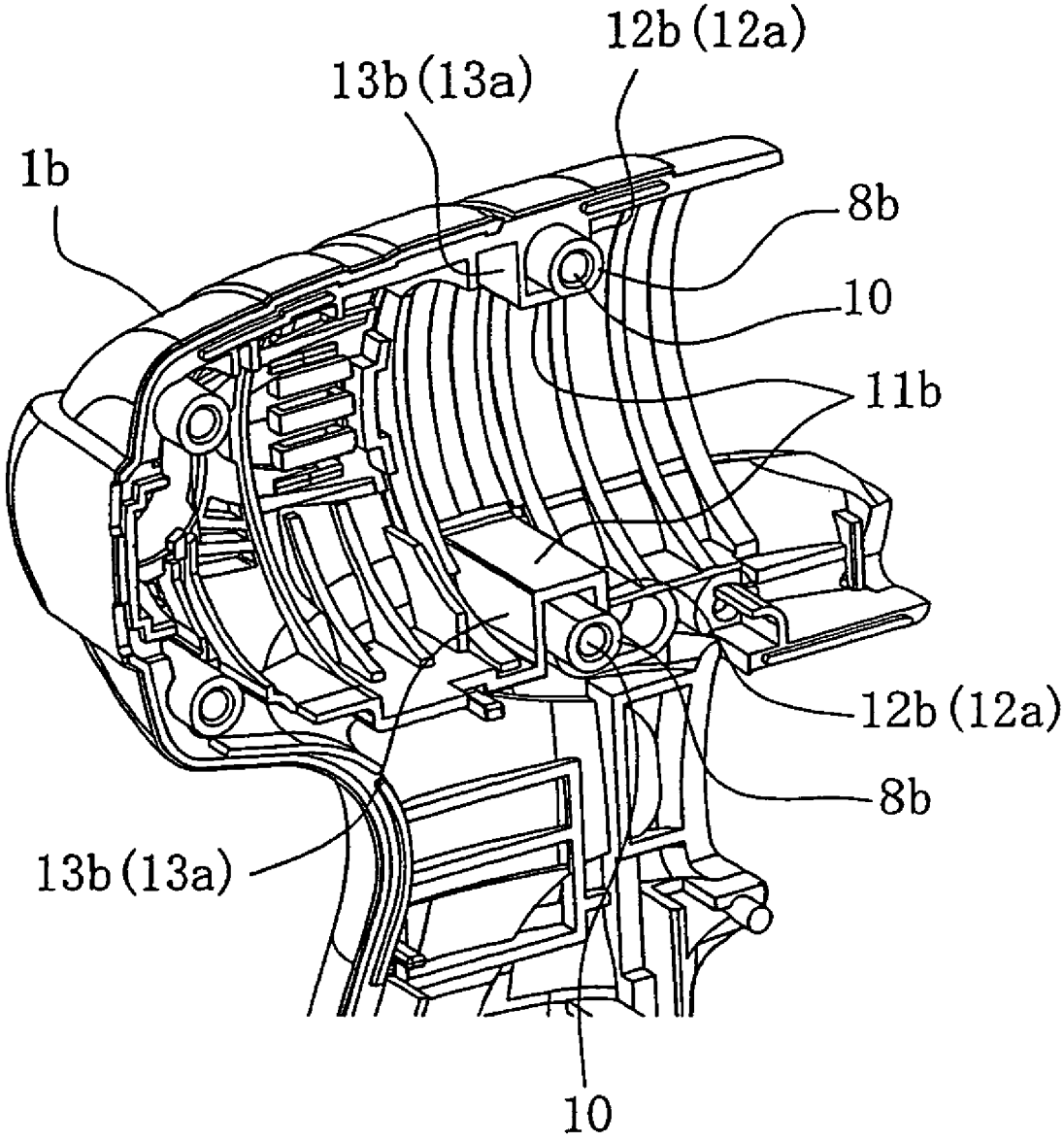
FIG. 6 is a partial perspective view of the other half portion of the housing of the electric power tool as shown in FIG. 1.

As shown in FIGS. 1 to 3, of the bosses formed on the upper portion of the housing 1, the bosses 8*a*, 8*b*, which are formed on the half portions 1*a*, 1*b* of the housing, respectively, so as to be in the vicinity of the hammer case 3, have specific structures. More specifically, the bosses 8*a*, 8*b* on the upper side have flat surfaces 11*a*, 11*b* that are flush with each other so as to come into contact with the upper surface of the inner case 2, and the bosses 8*a*, 8*b* on the lower side also have flat surfaces 11*a*, 11*b* that are flush with each other so as to come into contact with the lower surface of the inner case 2. In addition, the pair of bosses 8*b*, which are provided opposite to each other on the upper side of the half portion 1*b*, have projections each having rounded surfaces on their outer sides and flat surfaces on their inner sides. On the other hand, the pair of bosses 8*a*, which are provided opposite to each other on the upper side of the other half portion 1*a*, have recesses each having the shape that is capable of receiving the above-mentioned projection of the half portion 1*b*. As shown in FIGS. 2, 3 and 6, the bosses 8*a*, 8*b* have the flat surfaces 11*a*, 11*b* facing inward to each other in the upper side of the housing 1, as well as the flat surfaces 12*a*, 12*b* facing forward and the flat surfaces 13*a*, 13*b* facing rearward. These flat surfaces are provided in the form of smooth surfaces. When the half portions 1*a*, 1*b* are combined to each other, the flat surfaces 11*a*, 12*a* and 13*a* of the half portion 1*a* are flush with the flat surfaces 11*b*, 12*b* and 13*b*, respectively. These bosses 8*a*, 8*b*, which are provided in the vicinity of the hammer case 3, engage with the hammer case 3 as described later. Such a specific structure in which the boss has three flat surfaces may be applied to only one of the upper and lower set of bosses.

Figure 9:
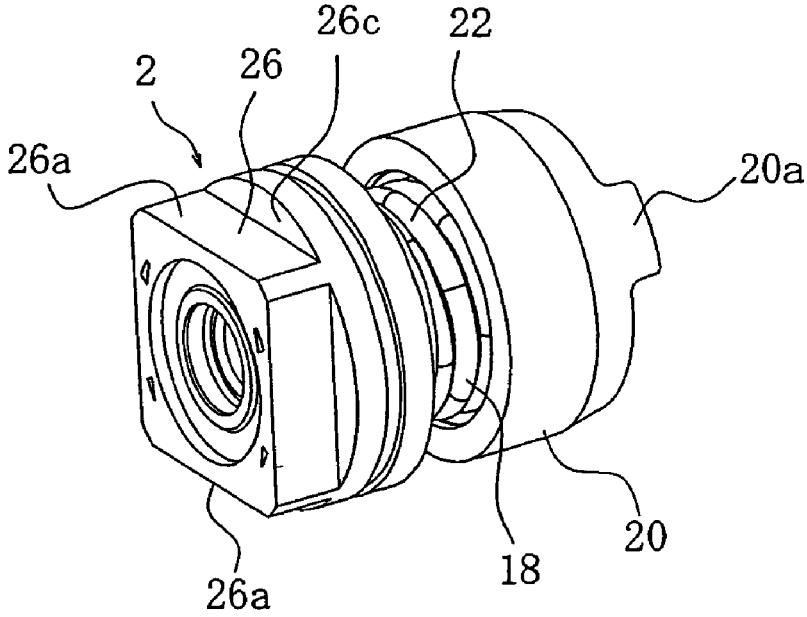
FIG. 9 is a perspective view of the inner case into which corresponding parts are assembled.

As shown in FIGS. 2 and 9, the inner case 2 is a cylindrical case for receiving a planetary gear train. The inner case 2 is fitted into the hammer case 3 and then inserted into the housing together with the hammer case 3 so as to be secured therein, as described later.

The planetary gear train is a speed reducer that transmits power of the drive shaft of the motor at a reduced speed. The planetary gear train includes a sun gear 14, planet gears 15 placed around the sun gear 14 so as to engage with it, a carrier 16 that supports the planet gears 15 and an internal gear 17 with which the planetary gears 15 engage. The sun gear 14 is formed integrally with the drive shaft 4*a* of the motor 4. The internal gear 17 is provided on the inner wall of the inner case 2. The carrier 16, which is formed integrally with a transmission shaft 18, is supported on the inner case 2 through a bearing 19.

The planetary gear train transmits the rotational power of the drive shaft 4*a* of the motor 4 to the transmission shaft 18 at the reduced speed. The rotation power of the transmission shaft 18 is then transmitted to a hammer unit described later, which is placed in the hammer case 3.

In a preferable case, the inner case 2 is formed integrally with the internal gear 17 of sintered alloy. However, the inner gear 17 formed of metal may be combined with the inner case formed of synthetic resin by insert injection.

Figure 7:
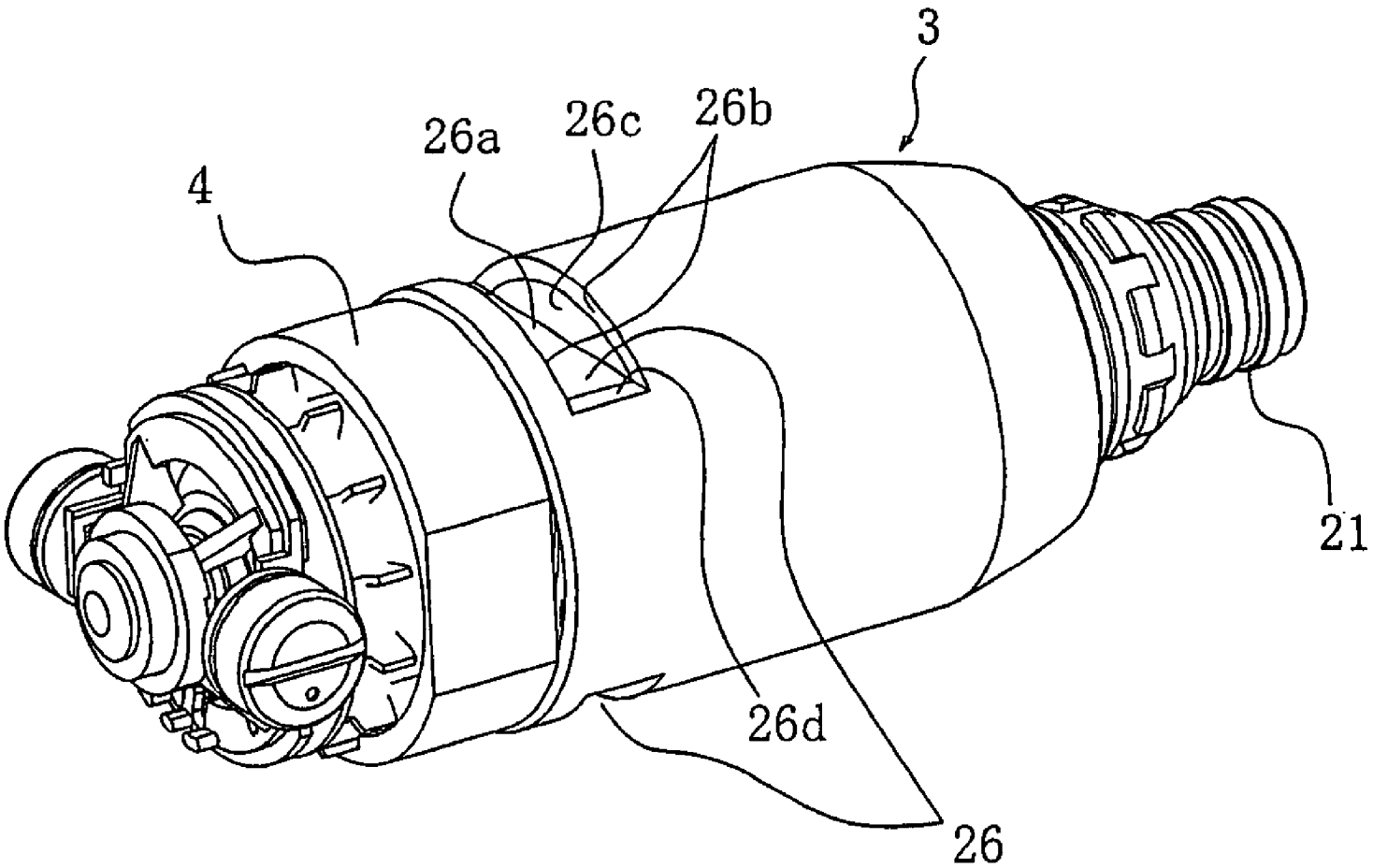
FIG. 7 is a perspective view of the hammer case with which the inner case and a motor are combined.
Figure 8:
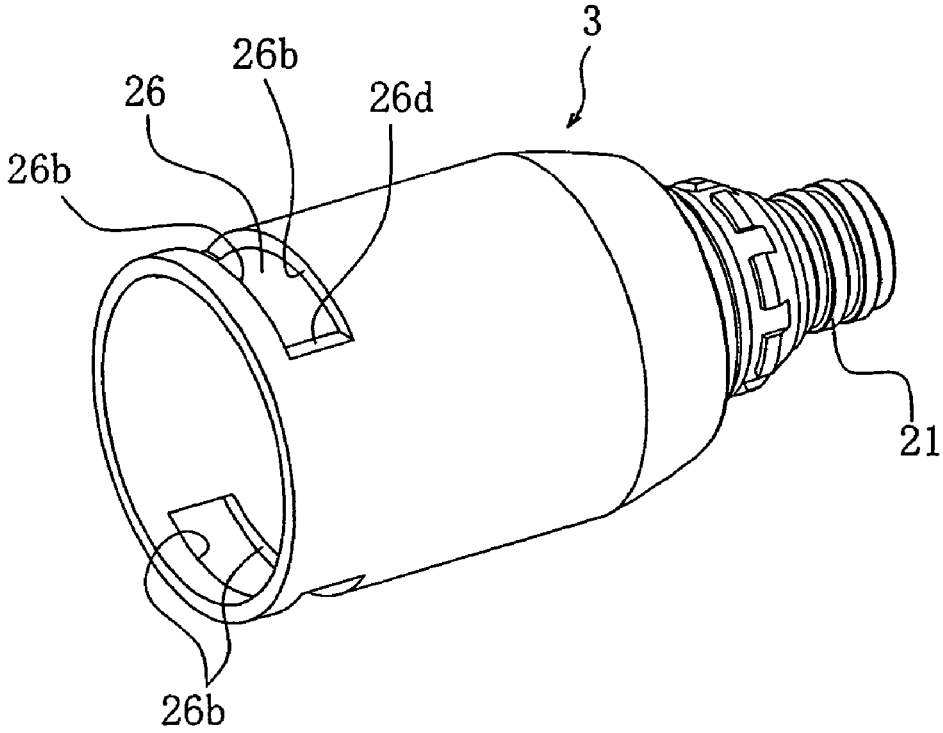
FIG. 8 is a perspective view of the hammer case into which corresponding parts are assembled.

As shown in FIGS. 1, 7 and 8, the hammer case 3 is a tubular case that received the hammer unit and has a smaller diameter at the front side. The above-described inner case 2 is fitted into the rear side of the hammer case 3. The hammer case 3 and the inner case 2, which has been combined with each other in this manner, are stationarily placed in the upper side of the housing 1. The hammer case 3 including the hammer unit is inserted into the housing in this manner so as to be secured directly to the housing 1, with the result that securing force by which the hammer case 3 is supported on the housing is enhanced, thus leading to increased strength of the power tool. The hammer case 3 is covered with an outer cover, which is formed of synthetic resin, so as to be flush with the outer surface of the housing 1.

The hammer unit is composed of the above-described transmission shaft 18, which is formed integrally with the above-described carrier 16, a hammer 20 placed around the transmission shaft 18, an anvil 21 to which an intermittent striking power is applied in the circumferential direction by the hammer 20, and an elastic member, i.e., a compression spring 22 for pressing the hammer 20 toward the anvil 21. The transmission shaft 18 is provided on its outer surface with a spiral groove 23. The hammer 20 is provided on its inner surface with a straight groove 24. The hammer 20 is operatively connected to the transmission shaft 18 through a ball 25 received in the above-mentioned spiral groove 23 and straight groove 24. The anvil 21 has wing portions 21*a*, to which an intermittent striking power is applied in the circumferential direction by a projection 20*a* of the hammer 20 in the hammer case 3. The anvil 21 projects at its tip end from the front edge of the hammer case 3. A bit (not shown) is detatchably attached to the tip end of the anvil 21.

When the planetary gear train outputs the rotational power of the drive shaft 4*a* of the motor 4 at the reduced speed from the transmission shaft 18, the hammer 20 rotates together with the transmission shaft 18, while sliding reciprocally on the transmission shaft 18 under a cam action caused by the spiral groove 23, the straight groove 24 and the ball 25, as well as a repeatedly pressing action caused by the compression spring 22, so that the projection 20*a* of the hammer 20 repeatedly strikes the wing portion 21*a* of the anvil 21 in its circumferential direction. Accordingly the anvil intermittently turns in one direction, thus permitting a screwing operation utilizing the bit.

The intermittent strike of the anvil 21 by the hammer 20 causes a rotational power and an axial transmission power to be transmitted to the housing 1 through the planetary gear train, the inner case 2 and the hammer case 3. In order to prevent an unfavorable relative movement between the hammer case 3 and the inner case 2 from occurring due to the above-mentioned rotational power and axial transmission power, the inner case 2 and the hammer case 3 are secured to the housing 1 by means of a securing system described below.

More specifically, as shown in FIGS. 2, 5, and 7 to 9, the inner case 2 has on its outer peripheral surface a pair of opposite recesses 26, the hammer case 3 has a pair of elongated holes that are aligned with the recesses 26, respectively, and the bosses 8*a*, 8*b* of the housing 1 engage with the elongated holes of the hammer case 3 and the recesses 26 of the inner case 2.

Each of the bosses 8*a*, 8*b* of the housing 1 has the innermost end surfaces 11*a*, 11*b* and a pair of opposite outer surfaces 12*a*, 12*b*, 13*a*, 13*b*. The inner case 2 has substantially the square pole portion at its rear side, which includes four bottom walls 26*a* and the corresponding inner walls 26*c*, as shown in FIG. 9. The bottom wall 26*a* serves as the first receiving surface, which comes into contact with the inner most end surfaces 11*a*, 11*b* of the boss 8*a* or 8*b* of the housing 1, as shown in FIGS. 2 and 7. The inner wall 26*c* serves as the second receiving surface, which comes into contact with the outer surface 12*a*, 12*b*, 13*a*, 13*b* of the boss 8*a*, 8*b*, as shown in the same figures. Each of the elongated holes is defined by the first pair of opposite edges 26*d* and the second pair of opposite edges 26*b*, as shown in FIG. 7. The first pair of opposite edges 26*d* comes into contact with the inner most end surface 11*a* (11*b*) of the boss 8*a* (8*b*). The second pair of opposite edges 26*b* comes into contact with the pair of opposite outer surfaces 12*a*, 13*a* (12*b*, 13*b*).

As a result, the innermost end surface 11*a*, 11*b* of the boss 8*a*, 8*b* of the housing 1, the bottom wall 26*a* of the recess of the inner case 2 and the first pair of opposite edges 26*d* of the hammer case 3 serve as members that prevent the inner case 2 and the hammer case 3 from unfavorably turning relative to the housing 1, even when an intermittent striking power generated by the hammer unit and its reaction force are transmitted in the form of rotational force through the inner case 2 and the hammer case 3 to the hosing 1. Consequently, it is possible to prevent an undesirable movement among the housing 1, the inner case 2 and the hammer case 3 in the circumferential direction thereof, thus leading to an extended service life of the power tool.

In addition, the pair of opposite outer surfaces 12*a*, 12*b*, 13*a*, 13*b* of the bosses 8*a*, 8*b*, the inner walls 26*c* of the inner case 2 and the second pair of opposite edges 26*b* of the hammer case 3 serve as members that prevent, even when the intermittent striking power is transmitted through the inner case 2 and the hammer case 3 to the housing 1 in the form of force acting in the axial direction of the housing 1, the inner case 2 and the hammer case 3 from coming off the housing 1 in the axial direction of the housing 1. Consequently, it is possible to prevent an undesirable movement among the housing 1, the inner case 2 and the hammer case 3 in the axial direction of the housing 1, thus leading to an extended service life of the power tool.

Further, the inner case 2 has the recesses 26, the hammer case 3 has the elongated holes, which are aligned with the recesses 26 of the inner case 2, and the half portion 1*a*, 1*b* has the bosses 8*a*, 8*b* so that the bosses 8*a*, 8*b* are engageable with the elongated holes of the hammer case 3, which are aligned with the recesses 26 of the inner case 2. As a result, it is possible to make positional determination among the hammer case 3, the inner case 2 and the housing 1, thus providing an easy assembling operation.

Now, operation of the impact driver having the above-described structure will be described below.

An assembling operation of the impact driver is carried out as follows.

First, the planetary gear train is combined to the inner case 2. Then, the compression spring 22, the hammer 20 and the other components are connected to the transmission shaft 18. An inner case assembly as shown in FIG. 9 is prepared in this manner.

The anvil 21 is inserted into the hammer case 3 from the rear opening thereof so as to project from the front end thereof. A hammer case assembly as shown in FIG. 8 is prepared in this manner.

Then, the inner case assembly is inserted into the hammer case 3 of the hammer case assembly from the rear opening as shown in FIG. 7. In this case, the elongated holes of the hammer case are aligned with the opposite bottom walls 26*a* of the recesses of the inner case 2 so as to make a positional determination of the inner case 2 relative to the hammer case 3.

Figure 4:
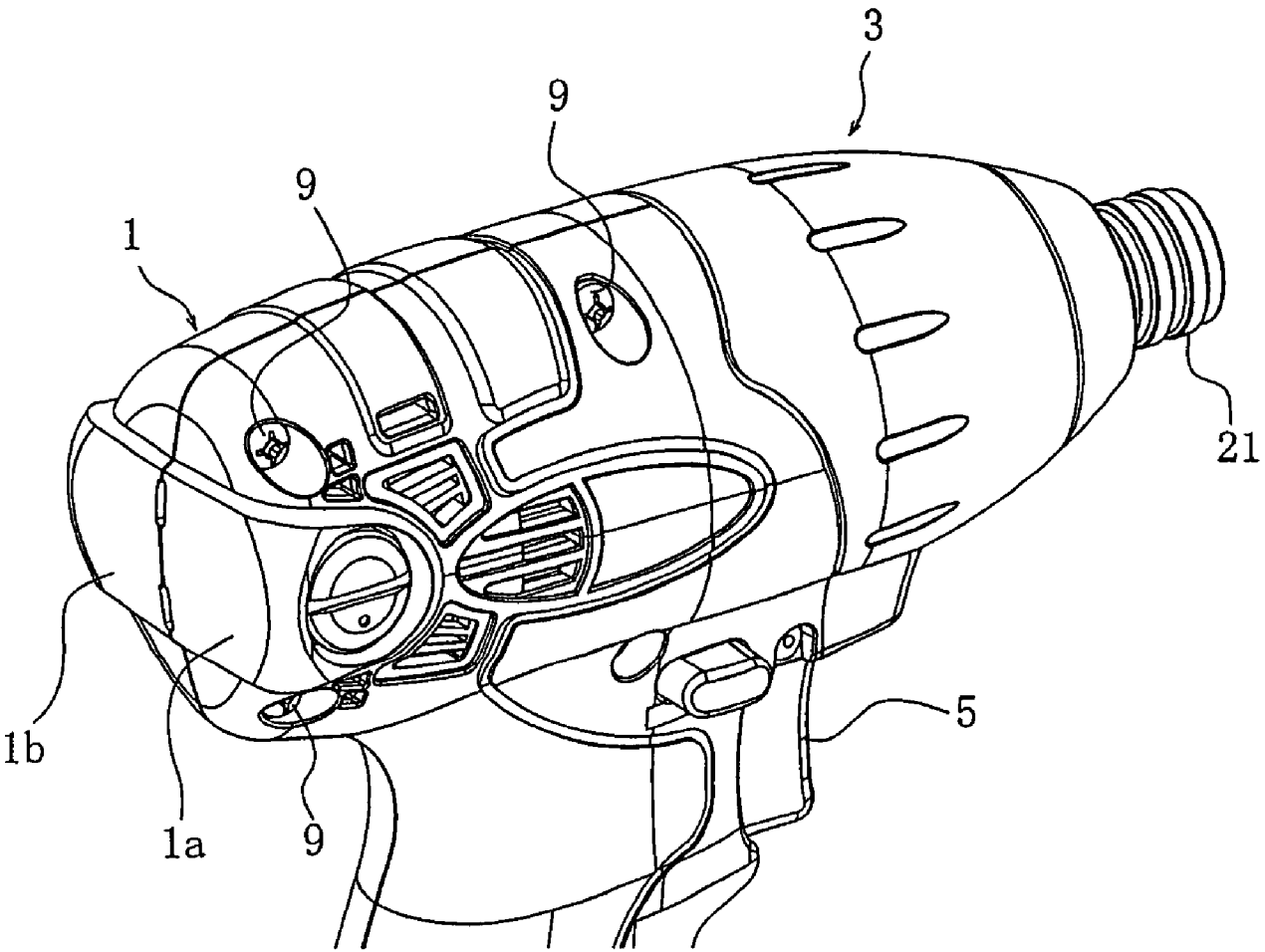
FIG. 4 is a partial perspective view of the upper section of the electric power tool as shown in FIG. 1.
Figure 5:
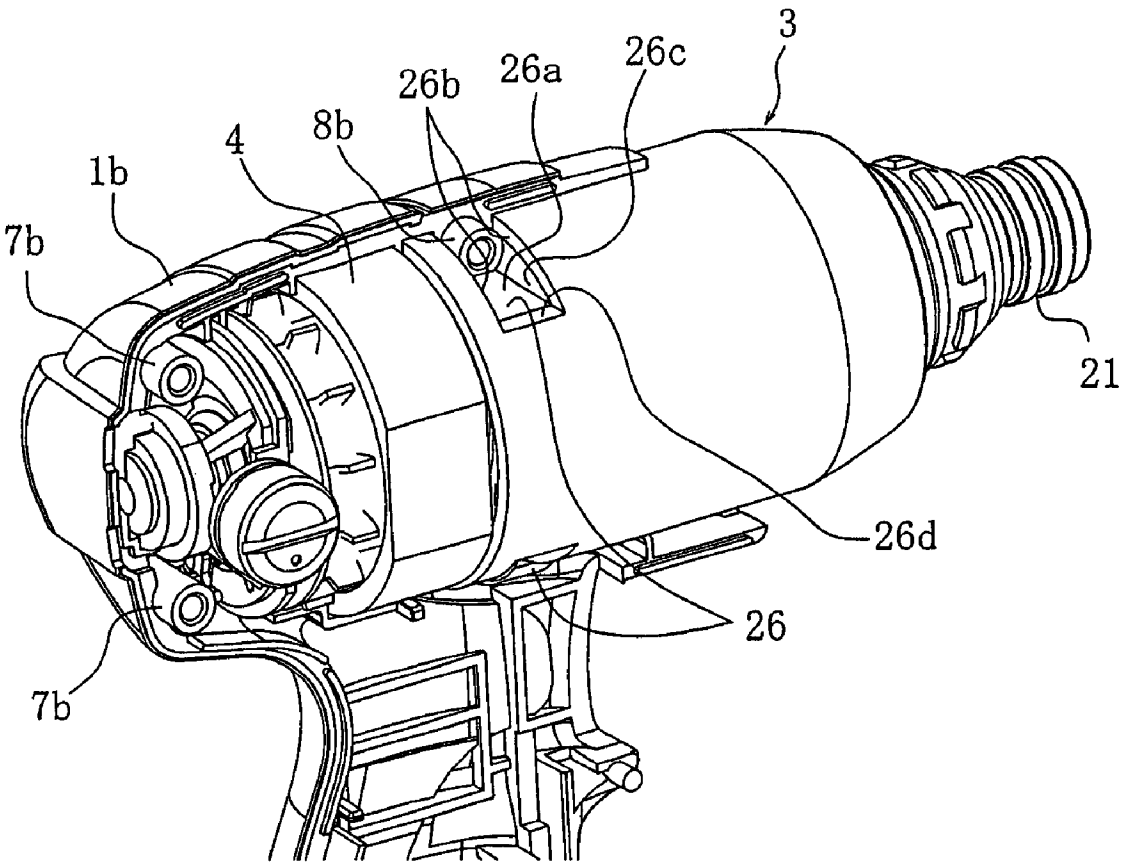
FIG. 5 is a partial perspective view of the electric power tool, with one of the half portions of the housing removed.

Then, the motor 4 is placed on the rear side of the hammer case 3, as shown in FIG. 7 so that the sun gear 14 of the planetary gear train, which is the same as the front end of the drive shaft 4*a* of the motor 4, is caused to engage with the planetary gears 15, as shown in FIG. 2. The half portion 1*b* as shown in FIG. 6 is placed on the left-hand side of the hammer case 3, and the other half portion 1*a* is placed on the right-hand side of the hammer case 3, as shown in FIG. 4, so that the end surfaces of the bosses 7*a*, 8*a* of the half portion 1*a* come into contact with the end surfaces of the bosses 7*b*, 8*b* of the half portion 1*b*, respectively. At this stage, the bosses 8*a*, 8*b*, which are placed in the vicinity of the hammer case 3, are fitted into the elongated holes of the hammer case 3, which are aligned with the recesses 26 of the inner case 2. Then, the screws 9 are inserted into the threaded holes 10 of the bosses 7*a*, 7*b*, 8*a*, 8*b* and tightened to provide an assembled housing 1.

Carrying out the above-described steps enables a rapid and accurate positional determination of the hammer case 3 relative to the housing 1 to be made and the hammer case 3 to be held stationarily in the housing 1. The assembling operation for the impact driver is completed in this manner.

When an operator holds the handle of the impact driver with one hand and pulls the trigger 5 with his/her finger, the motor 4 operates to rotate the transmission shaft 18 whose speed is reduced by the planetary gear train, together with the hammer 20, so that the hammer 20 intermittently strikes the anvil 21. A screwing operation is performed with the use of the bit (not shown) attached to the anvil 21.

The hammer case 3 is appropriately received in the housing 1 and the bosses 8*a*, 8*b* of the housing 1 engage with the elongated holes of the hammer case 3 and the recesses 26 of the inner case 2. Accordingly, the hammer case 3 can be firmly secured to the housing 1. The screwing operation can therefore be carried out smoothly. In addition, the housing 1 has a smooth outer surface without any projections. It is therefore possible to carry out smoothly the screwing operation without causing damage to a material into which screws are to be inserted, even when an operator performs the screwing operation at a corner or narrow portion.

According to the present invention, the innermost end surface 11*a*, 11*b* of the boss 8*a*, 8*b* of the housing 1 comes into contact with the first receiving surface, i.e., the bottom wall 26*a* of the recess of the inner case 2 and the second receiving surface, i.e., the first pair of opposite edges 26*d* of the hammer case 3. Even when an intermittent striking power generated by the hammer unit and its reaction force are transmitted in the form of rotational force through the inner case 2 and the hammer case 3 to the hosing 1, the first and second receiving surfaces bear such a rotational force. In addition, the pair of opposite outer surfaces 12*a*, 12*b*, 13*a*, 13*b* of the bosses 8*a*, 8*b* come into contact with the third receiving surface, i.e., the inner walls 26*c* of the inner case 2 and the fourth receiving surface, i.e., the second pair of opposite edges 26*b* of the hammer case 3. Even when the intermittent striking power is transmitted through the inner case 2 and the hammer case 3 to the housing 1 in the form of force acting in the axial direction of the housing 1, the third and fourth receiving surfaces bear such a force in the axial direction of the housing 1. Consequently, it is possible to prevent an undesirable movement among the housing 1, the inner case 2 and the hammer case 3 in the axial direction of the housing 1, thus leading to an extended service life of the power tool.

When an inspection or repair in the inside of the housing 1 is required, a loosening operation of the screws 9 suffices to disassemble the housing 1. More specifically, the housing 1 can be disassembled independently from the inner case 2 and the hammer case 3 into the half portions 1*a*, 1*b* to expose the inside of the housing 1, while leaving the assemblies for the inner case 2 and the hammer case 3 as they are. When the components are assembled into the impact driver again, the same operation as the above-described assembling operation suffices to combine the half portions 1*a*, 1*b* so that the bosses 8*a*, 8*b* are fitted into the elongated holes of the hammer case 3, which are aligned with the recesses 26 of the inner case 2, to provide the assembled housing 1.

The present invention is not limited only to the above-described preferred embodiment in which the present invention is applied to the impact driver. The present invention may be applied to the other electric power tool.

In the above-described embodiment of the present invention, the inner case 2 has on its outer peripheral surface a pair of opposite recesses 26, the hammer case 3 has a pair of elongated holes that are aligned with the recesses 26, respectively, and the bosses 8*a*, 8*b* of the housing 1 engage with the elongated holes of the hammer case 3 and the recesses 26 of the inner case 2. However, it may be adopted a structure in which the inner case 2 has on its outer peripheral surface a single recess, the hammer case 3 has a single elongated hole that is aligned with the recess, and the single boss of the housing 1 engages with the elongated hole of the hammer case 3 and the recess of the inner case 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2004-46028 filed on Feb. 23, 2004 including the specification, claims, drawings and summary is incorporated herein by reference in its entirety.

What is claimed is:

1. An electric power tool comprising:

a housing in which a motor having a drive shaft is disposed, said housing being composed of a pair of half portions that are to be assembled into a united body;

an inner case for receiving a planetary gear train having an input side and an output shaft, said input side of the planetary gear train being connected to the drive shaft of the motor to transmit power of the motor to the output shaft at reduced speed, said inner case being received in the housing; and a hammer case for receiving a hammer unit having an input side and an output shaft, said input side of the hammer unit being connected to the output shaft of the planetary gear train to convert rotational motion of the output shaft of the planetary gear train into an intermittent striking power outputted from the output shaft of the hammer unit, said inner case being received in said hammer case, wherein:

said inner case has on an outer peripheral surface thereof at least one recess;

said hammer case has at least one elongated hole that is aligned with said at least one recess of the inner case; and each of said half portions has bosses through which fastening members pass to fasten the half portions into said united body, at least one of said bosses being engageable with said at least one elongated hole of the hammer case, which is aligned with said at least one recess of the inner case.

2. The electric power tool as claimed in claim 1, wherein:

said at least one of said bosses has an innermost end surface;

said inner case is provided in said at least one recess with a bottom wall by which said at least one recess is defined, said bottom wall being coming into contact with said innermost end surface of the at least one of said bosses; and said hammer case is provided along said at least one elongated hole with a first pair of opposite edges, said first pair of opposite edges being coming into contact with said innermost end surface of the at least one of said bosses.

3. The electric power tool as claimed in claim 2, wherein:

said at least one of said bosses has a pair of opposite outer surfaces; and said inner case is provided in said at least one recess with an inner wall by which said at least one recess is defined, said inner wall being coming into contact with one of said pair of opposite outer surfaces of the at least one of said bosses, respectively; and said hammer case is provided along said at least one elongated hole with a second pair of opposite edges, said second pair of opposite edges being coming into contact with said pair of opposite outer surfaces of the at least one of said bosses, respectively.

4. The electric power tool as claimed in claim 1, wherein:

said at least one of said bosses has a pair of opposite outer surfaces; and said inner case is provided in said at least one recess with an inner wall by which said at least one recess is defined, said inner wall being coming into contact with one of said pair of opposite outer surfaces of the at least one of said bosses; and said hammer case is provided along said at least one elongated hole with a second pair of opposite edges, said second pair of opposite edges being coming into contact with said pair of opposite outer surfaces of the at least one of said bosses, respectively.

5. The electric power tool as claimed in claim 1, wherein:

said inner case has a pair of opposite recesses serving as said at least one recess;

said hammer case has a pair of opposite elongated holes serving as said at least one elongated hole, which are aligned with said pair of opposite recesses of the inner case, respectively; and each of said half portions has a pair of opposite bosses serving as said at least one of said bosses, said pair of opposite bosses being respectively engageable with said pair of opposite elongated holes of the hammer case, which are aligned with said pair of opposite recesses of the inner case, respectively.

* * * * *